United States Patent [19]

Harwood et al.

[11] Patent Number: 4,765,437

[45] **Date of Patent: * Aug. 23, 1988**

[54] STAMP FORMED MUFFLER WITH MULTIPLE LOW FREQUENCY RESONATING CHAMBERS

[75] Inventors: Jon W. Harwood; Bruno A. Rosa, both of Toledo; Bennie A. Van Blaircum, Whitehouse; Mark S. Kimmet, Toledo, all of Ohio

[73] Assignee: AP Industries, Inc., Toledo, Ohio

[ * ] Notice: The portion of the term of this patent subsequent to Oct. 20, 2004 has been disclaimed.

[21] Appl. No.: 106,244

[22] Filed: Oct. 7, 1987

[51] Int. Cl.[4] ..... F01N 1/02; F01N 7/18

[52] U.S. Cl. ..... 181/282; 181/250; 181/266; 181/268; 181/272

[58] Field of Search ..... 181/239, 241–255, 181/266–269, 272, 276, 282

[56] References Cited

U.S. PATENT DOCUMENTS

| | | | |
|---|---|---|---|
| 2,484,827 | 10/1949 | Harley . | |
| 2,860,722 | 11/1958 | Gerstung . | |
| 2,943,695 | 7/1960 | Jeffords | 181/243 |
| 3,140,755 | 7/1964 | Tranel | 181/282 |
| 3,158,222 | 11/1964 | Richmond | 181/273 |
| 3,176,791 | 4/1965 | Betts et al. | 181/260 |
| 3,638,756 | 2/1972 | Thiele | 181/245 |
| 4,108,274 | 8/1978 | Snyder | 181/229 |
| 4,132,286 | 1/1979 | Hasui et al. | 181/265 |
| 4,396,090 | 8/1983 | Wolfhugel | 181/282 |
| 4,456,091 | 6/1984 | Blanchot | 181/282 |
| 4,700,806 | 10/1987 | Harwood | 181/282 |

FOREIGN PATENT DOCUMENTS

| | | |
|---|---|---|
| 5815708 | 7/1981 | Japan . |
| 59-155528 | 9/1984 | Japan . |
| 59-43456 | 12/1984 | Japan . |
| 61-155625 | 3/1985 | Japan . |
| 60-111011 | 6/1985 | Japan . |
| 61-14565 | 5/1986 | Japan . |
| 61-108821 | 5/1986 | Japan . |
| 632013 | 1/1950 | United Kingdom . |
| 1012463 | 12/1965 | United Kingdom . |
| 2120318 | 11/1983 | United Kingdom . |

*Primary Examiner*—B. R. Fuller

*Attorney, Agent, or Firm*—Anthony J. Casella; Gerald E. Hespos

[57] ABSTRACT

A muffler is provided with a pair of internal plates stamp formed to define an array of tubes therebetween. An external shell, which may be stamp formed, surrounds and encloses at least selected portions of the internal plates. The array of tubes stamp formed in the internal plates includes at least two tuning tubes. One tuning tube terminates at a tuning aperture in one of the two internal plates, while the other tuning tube terminates at an aperture stamp formed in the other of the two internal plates. Thus, one tuning tube will communicate with a low frequency resonating chamber on one side of the pair of internal plates, while the other tuning tube will communicate with a low frequency resonating chamber on the opposite side of the assembled internal plates.

19 Claims, 3 Drawing Sheets

STAMP FORMED MUFFLER WITH MULTIPLE LOW FREQUENCY RESONATING CHAMBERS

RELATED APPLICATIONS

This application is related to the following copending applications: 1. U.S. patent application Ser. No. 934,642 filed Nov. 25, 1986 for "STAMP FORMED MUFFLER" by Jon W. Harwood; 2. U.S. patent application Ser. No. 061,876 filed June 11, 1987 for "EXHAUST MUFFLER WITH ANGULARLY ALIGNED INLETS AND OUTLETS" by Jon. W. Harwood et al; and 3. U.S. patent application Ser. No. 061,913 filed June 11, 1987 for "TUBE AND CHAMBER CONSTRUCTION FOR AN EXHAUST MUFFLER" by Jon W. Harwood et al. These copending applications are assigned to the assignee of the subject application. The disclosures of these copending applications are incorporated herein by reference.

BACKGROUND OF THE INVENTION

The prior art exhaust muffler comprises an array of tubes disposed within an outer shell. The array of tubes defines at least one inlet and at least one outlet which extend through the outer shell of the muffler and enable the muffler to be connected into an exhaust system. Portions of the array of tubes within the typical prior art muffler are perforated to permit a controlled circulation of exhaust gases into an expansion chamber defined between the perforated tubes and the outer shell of the muffler. This circulation of gases into and/or through the expansion chamber contributes to the sound attenuation of the muffler.

The particular sound attenuation achieved by the prior art muffler depends upon a host of design parameters including the characteristics of the exhaust gases, the dimensions of the tubes within the muffler, the area of the perforations in the tubes and the volume of the expansion chamber. Some prior art mufflers include a plurality of expansion chambers of different engineering designs in an effort to attenuate specified ranges of noises. For example, a small chamber with a single perforated tube passing therethrough often is provided to attenuate a narrow, high frequency range of sounds, and is referred to as a high frequency tuning chamber.

Expansion chambers and high frequency tuning chambers often are not sufficient to achieve specified noise attenuation levels. More particularly, it is often found that a relatively narrow band of unacceptable noise exists despite properly engineered expansion chambers and high frequency tuning chambers. Most exhaust mufflers accommodate this residual noise with one or more tuning tubes and a corresponding number of low frequency resonating chambers. In this context, a low frequency resonating chamber is defined as a substantially enclosed chamber, and a tuning tube extends into the low frequency resonating chamber and is in communication with other tubes carrying exhaust gases from the inlet to the outlet of the muffler. Thus, the combination of a tuning tube and a low frequency resonating chamber performs a noise attenuation function, but no significant function in carrying exhaust gases between the inlet and outlet of the muffler. Low frequency resonating chambers and tuning tubes employ principles similar to those involved in playing a flute or blowing across the top of a bottle. In particular, the range of frequencies that will be attenuated by a low frequency resonating chamber is determined by the length and cross-sectional area of the tuning tube and the volume of the low frequency resonating chamber. In many instances, a plurality of functionally distinct low frequency resonating chambers will be required within an exhaust muffler to achieve specified noise levels.

The typical prior art muffler employs a plurality of separate tubes supported in generally parallel relationship on a plurality of transversely extending baffles. A sheet of metal is then wrapped into an oval or circular cross section to define an outer shell which envelopes the tubes and baffles. A pair of opposed heads then are secured to opposite ends of the tubular outer wrapper to complete the prior art muffler. The various chambers of the these prior art mufflers are formed between either the outer shell, a head and a baffle or between the outer shell and a pair of baffles. A typical prior art muffler of this general construction might include a total of four internal baffles which define an expansion chamber and two low frequency resonating chambers within the muffler. In certain unusual instances, the prior art muffler may require five transverse baffles to create the required number of chambers within the muffler.

The above described wrapped outer shell muffler is by far the most prevalent exhaust muffler employed on vehicles. However, there have been many efforts to develop mufflers with at least some stamp formed components. For example, U.S. Pat. No. 4,396,090 which issued to Wolfhugel on Aug. 2, 1983, shows an exhaust muffler with a pair of plates stamp formed to define an array of tubes, a plurality of transverse baffles to support the internal plates and to define chambers within the muffler and a wrapped outer shell. Other stamp formed mufflers consist of two stamp formed external shells configured to define a convoluted path through which exhaust gases may travel. These prior art mufflers include U.S. Pat. No. 2,484,827 which issued to Harley and U.S. Pat. No. 3,638,756 which issued to Thiele. Still other stamp formed mufflers have included a pair of stamp formed outer shells and one or more stamp formed internal components defining tubes and baffles within the outer shells. Examples of these mufflers are shown in British Patent No. 632,013 which issued to White in 1949; British Patent No. 1,012,463 which issued to Woolgar on Dec. 8, 1965; and U.S. Pat. No. 4,132,286 which issued to Hasui et al. on Jan. 2, 1979.

Japanese Patent No. 59-43456 shows one muffler formed substantially entirely with stamp formed components and another muffler formed with a combination of stamp formed and tubular components. Both embodiments shown in Japanese Patent No. 59-43456 include inserts mounted in selected tubes to divert portions of the exhaust gases through perforations downstream from the insert. Both embodiments also create chambers with folded flaps on the internal plates and/or with separate stamp formed baffles. The embodiment of Japanese Patent No. 59-43456 formed entirely with stamp formed components includes two chambers defined as resonance chamber. These resonance chambers communicate directly with a large expansion chamber, and not with any of the stamp formed tubes. In particular, this muffler does not include a tuning tube, the length and cross-sectional area of which partially determine the specific frequency of noise to be attenuated. The other embodiment shown in Japanese Patent No. 59-43456 does include a single resonance chamber with a stamp formed tuning tube. However, this embodiment requires the undesirable combination of stamp formed and tubular components to make the muffler functional.

The above identified copending patent applications describe several substantial improvements to mufflers formed from stamp formed components. In particular, copending application Ser. No. 934,642 shows several novel constructions for mufflers formed from three or more stamp formed members to yield an array of tubes, at least one expansion chamber and at least one low frequency resonating chamber. Similarly, copending patent application Ser. No. 061,876 and copending patent application Ser. No. 061,913 each show mufflers formed from stamp formed components which define an expansion chamber, a reversing chamber and a low frequency resonating chamber. In particular, copending application Ser. No. 061,876 shows a stamp formed muffler with efficient alignments of the inlet and outlet tubes. Copending application Ser. No. 061,913 shows several efficient constructions for the tubes and chambers within the stamp formed muffler.

Despite the many advantages offered by stamp formed mufflers in general, and in particular by the copending applications identified above, it has been found desirable to make further improvements in stamp formed mufflers. More particularly, it has been found desirable to provide mufflers having stamp formed components and having a plurality of low frequency resonating chambers.

In view of the above, it is an object to provide a muffler having stamp formed components and having a plurality of low frequency resonating chambers.

It is another object of the subject invention to provide a muffler having a plurality of low frequency resonating chambers without separate internal baffles.

It is an additional object of the subject invention to provide an exhaust muffler with a plurality of low frequency resonating chambers without the formation of additional convolutions or chambers within the outer shell of the muffler.

SUMMARY OF THE INVENTION

The subject invention is directed to a muffler formed from a pair of internal plates secured in face-to-face relationship and stamp formed to define an array of tubes therebetween. At any selected location in said array, the tube may be defined by two oppositely directed channels secured in juxtaposed relationship or alternatively by a channel in one internal plate secured to a planar portion of the other internal plate. The muffler further comprises an external shell surrounding and substantially enclosing the internal plates. The external shell may be formed from a pair of stamp formed shells disposed respectively on opposite sides of the internal plates. Alternatively, the external shell may be formed from one or more sheets of metal wrapped into a generally tubular configuration, with the internal plates disposed therein, and with a pair of opposed heads mechanically connected to the opposed ends of the wrapped outer shell.

The array of tubes defined by the stamp forming of the internal plates comprises at least one inlet tube and at least one outlet tube connectable respectively to an exhaust pipe and tail pipe of an exhaust system. The array of tubes may undergo a plurality of bends intermediate the inlet and the outlet to define a circuitous path through which the exhaust gases travel in passing through the muffler. Alternatively, a single linear tube may extend from the inlet to the outlet. Selected portions of the tubes defined by the internal plates may be characterized by perforations stamp formed therein. These arrays of perforations may be disposed to communicate with an expansion chamber defined intermediate the external shell and the stamp formed internal plates. On embodiments of the muffler formed entirely from stamp formed components, the expansion chamber may be defined by at least one crease stamp formed in the external shell, such that the crease engages the internal plate to define an enclosed chamber. In embodiments of the muffler where the external shell is formed from generally tubular wrapped sheet metal, the expansion chamber may be defined by an appropriate deformation stamp formed into one or both internal plates, and/or by a separate baffle extending between the stamp formed internal plates and the external shell.

The internal plates of the subject muffler are further stamp formed to define a plurality of tuning tubes communicating with one or more of the other tubes connecting the inlet and outlet of the muffler. As explained above, tuning tubes perform no significant exhaust gas carrying function, and are provided only to attenuate narrow ranges of noise. The tuning tubes may be entirely separate from one another, such that each tuning tube communicates directly with the other stamp formed tubes extending between the inlet and outlet of the muffler. Alternatively, the tuning tubes may communicate with one another, such that only one tuning tube communicates directly with the other tubes extending between the inlet and outlet of the muffler.

Each internal plate is stamp formed to define a tuning aperture at the end of one tuning tube. More particularly, the stamp formed apertures in the internal plates are disposed such that when the internal plates are placed in face-to-face relationship, the respective tuning apertures are disposed on different tuning tubes. Thus, one tuning tube will have a tuning aperture through one of the two stamp formed internal plates, while the other tuning tube will have a tuning aperture extending through the other of the two stamp formed internal plates.

The two tuning tubes will communicate respectively with two low frequency resonating chambers. On embodiments of the muffler formed entirely from stamp formed components, the low frequency resonating chambers may be defined by the stamp formed configuration of the external shells. More particularly, the low frequency resonating chamber may be defined intermediate the periphery of each stamp formed external shell and the crease stamp formed in the external shell to define the expansion chamber. In embodiments of the muffler employing a generally tubular wrapped sheet metal outer shell, the low frequency resonating chamber may be defined by an internal baffle or by the appropriate stamped configuration of the internal plates.

The above described construction enables two low frequency resonating chambers to be provided in the space of a muffler that previously had been devoted to a single low frequency resonating chamber, thereby providing more efficient use of the available space and minimizing the amount of stamp forming required and/or the number of separate internal baffles employed. For example, on embodiments employing all stamp formed components, the muffler may be provided with an expansion chamber and two distinct low frequency resonating chambers with each stamp formed external shell being provided with only a single crease therein.

Thus, each of the two exteral shells may be stamp formed to define a portion of a single expansion chamber plus one entire and functionally separate low frequency resonating chamber. The requirement for only a single crease stamp formed in each of the two external shells substantially minimizes the deformation of the metal from which the exteral shells are formed. Consequently, the dies are easier to design, the metal is subjected to less stretching and product failures are less likely.

The tuning apertures described above generally will define an area at least equal to the cross-sectional area of the respective tuning tubes defined by the mated internal plates. These tuning apertures typically will define one single aperture in one of the two internal plates and preferably disposed substantially at the terminus of the corresponding tuning tube. As an alternative to this embodiment, however, one of the two tuning tubes may have a substantially enclosed end, but may be provided with a bleed pattern defined by an array of appropriately dimensioned perforations stamp formed in one of the internal plates. Thus, in this embodiment, one internal plate may be stamp formed to include a single tuning aperture at the end of the corresponding tuning tube, while the other internal plate may be stamp formed to define a bleed pattern of perforations disposed in the other of the two tuning tubes.

In all of the above described embodiments, the lengths of the respective tuning tubes, the cross-sectional areas of the tuning tubes and the volumes of the respective low frequency resonating chambers are selected to attenuate noises within a specified frequency range.

DETAILED DESCRIPTION OF THE PREFERRED EMBODIMENTS

Figure 1:
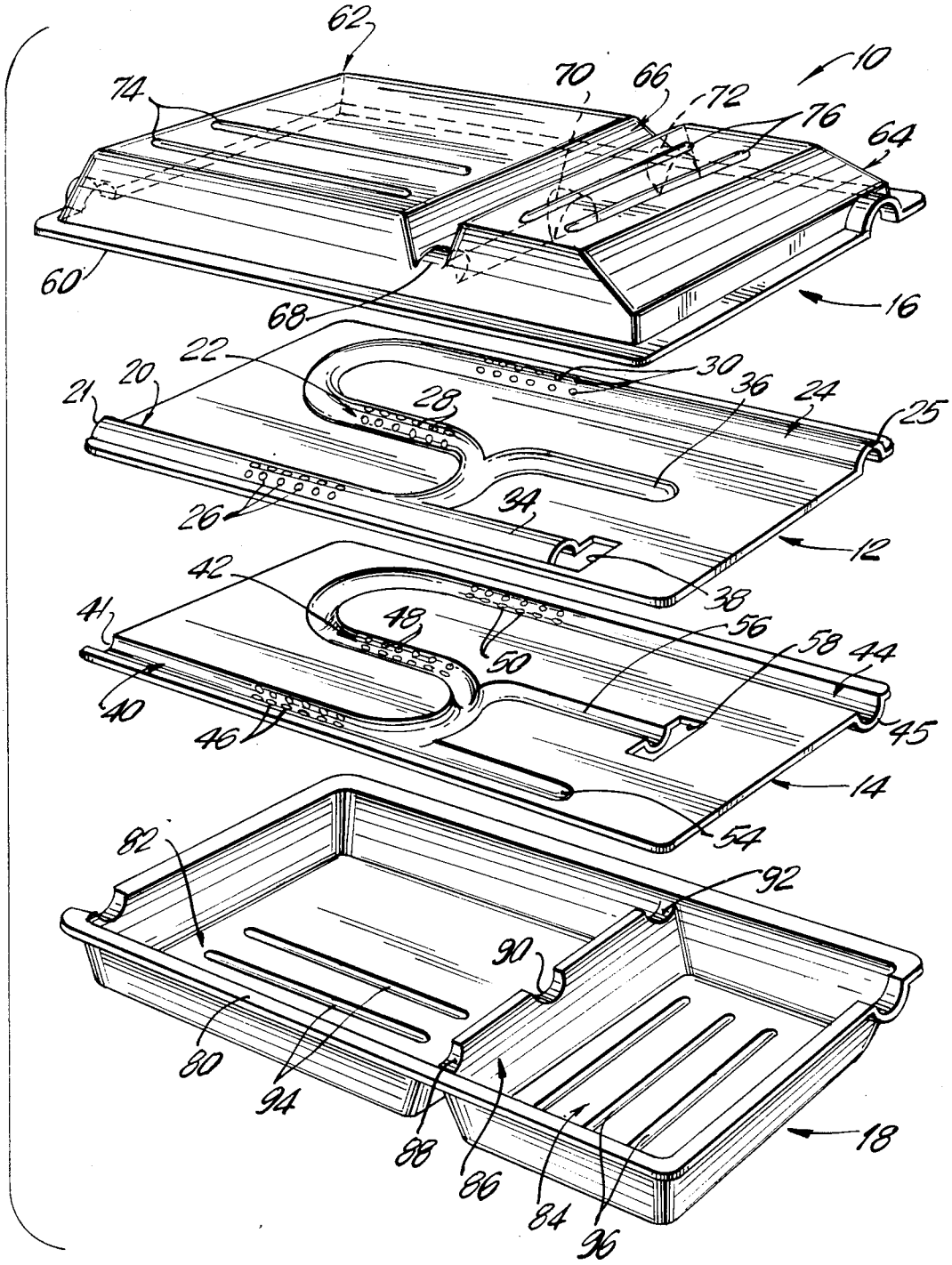
FIG. 1 is an exploded perspective view of a stamp formed muffler in accordance with the subject invention.

The muffler of the subject invention is indicated by the numeral 10 in FIG. 1. The muffler 10 comprises stamp formed internal plates 12 and 14 and stamp formed external shells 16 and 18. More particularly, the internal plates 12 and 14 are stamp formed to be secured in register with one another and to define an array of tubes therebetween. Similarly, the external shells 16 and 18 are stamp formed to be secured around the internal plates 12 and 14 and to define a plurality of chambers as explained in greater detail below.

The internal plate 12 is depicted as being of generally rectangular configuration. However, it is to be understood that the internal plate 12 and the other components of the muffler 10 may be of any nonrectangular configuration in accordance with the available space on the vehicle. The internal plate 12 is stamp formed to define an inlet channel 20 which extends from a peripheral location 21. A return channel 22 is in communication with the inlet channel 20, and an outlet channel 24 is in communication with the return channel 22 and extends to a peripheral location 25. The inlet channel 20, the return channel 22 and the outlet channel 24 include arrays of perforations 26, 28 and 30 respectively, which are disposed to lie within an expansion chamber of the muffler, as explained further below. Although the inlet channel 20, return channel 22 and outlet channel 24 are depicted as being of semicircular cross section, any cross-sectional configuration is acceptable for achieving the function of carrying exhaust gases and attenuating noise.

The internal plate 12 further comprises tuning channels 34 and 36 which communicate with the inlet channel 20 and the return channel 22 approximately at their juncture. The tuning channels 34 and 36 have cross-sectional dimensions and lengths which are dictated by the noise characteristics of the system into which the muffler 10 is to be incorporated. The tuning channels 34 and 36 are not necessarily of the same cross-sectional dimensions or lengths. The inlet channel 34 terminates at a tuning aperture 38 which defines an area no less than the cross-sectional area of the tuning tube to be defined by tuning channel 34 and the corresponding tuning channel on internal plate 14, as explained below. The tuning channel 36, however, does not terminate at an aperture through the internal plate 12.

The internal plate 14 is dimensioned and configured to be placed generally in register with the internal plate 12. The internal plate 14 includes an inlet channel 40 which extends from a peripheral location 41 on internal plate 14, and which is dimensioned to be substantially in register with the inlet channel 20 on internal plate 12. Internal plate 14 is further stamp formed to define a return channel 42 in communication with the inlet channel 40 and an outlet channel 44 which extends from the return channel 42 to a peripheral location 45 on the internal plate 14. The return channel 42 and the outlet channel 44 are disposed to be placed in register with the return channel 22 and the outlet channel 24 of the internal plate 12. The inlet channel, return channel and outlet channel 40–44 are provided respectively with arrays of perforations 46, 48 and 50. The perforation arrays 46–50 are depicted as being generally in register with the perforation arrays 26–30 on the internal plate 12. However, this precise alignment is not necessarily required, and may vary substantially depending upon the noise characteristics of the exhaust system and the available space for the muffler 10.

The internal plate 14 further comprises tuning channels 54 and 56 which are disposed to be in register with the tuning channels 34 and 36 respectively of the internal plate 12. The tuning channel 56 terminates at a tuning aperture 58 which defines an area equal to or greater than the cross-sectional area of the tuning tube defined by tuning channels 36 and 56. The tuning channel 54, however, does not terminate at an aperture stamp formed through the internal plate 14. As a result of this construction, when the internal plates 12 and 14 are placed in register with one another, the tuning tube defined by tuning channels 34 and 54 will terminate at a tuning aperture 38 extending through the internal plate 12. On the other hand, the tuning tube defined by the tuning channels 36 and 56 will terminate at the tuning aperture 58 which extends through the internal plate 14.

The external shell 16 is stamp formed to define a peripheral flange 60 extending thereabout. The peripheral flange 60 is depicted as being generally planar, but includes nonplanar portions disposed and dimensioned to engage corresponding peripheral portions 21 and 25 of the inlet and outlet channels 20 and 24 of the internal shell 12. The peripheral flange 60 will define the seam between the external shells 16 and 18, and its generally planar configuration is well suited to a highly automated assembly method. However, it is to be understood, that a nonplanar peripheral flange is possible and within the scope of the subject invention.

The external shell 16 is further stamp formed to define an expansion chamber 62 and a low frequency resonating chamber 64 with a crease 66 stamp formed therebetween. The crease 66 is dimensioned to extend into contact with the internal plate 12. Therefore, the crease 66 is characterized by arcuate portions 68, 70 and 72 which are disposed and dimensioned to engage corresponding portions of tuning channels 34 and 36 and outlet channel 24 on the internal plate 12. Preferably, the tuning channel 34 and the outlet channel 24 are disposed such that the arcuate portions 68 and 72 of the crease 66 extend continuously between adjacent sides of the expansion chamber 62 and the low frequency resonating chamber 64. Thus, as explained in applicant's copending application Ser. No. 061,913, the deformation required adjacent the peripheral flange 60 of the external shell 16 is minimized and the channels stamp formed into the internal plate 12 contribute to the strength of the external shell 16.

The crease 66 is disposed in the external shell 16 such that the expansion chamber 62 defined in part by crease 66 will surround and substantially enclose the perforation arrays 26, 28 and 30 in the internal plate 12. Additionally, the crease 66 is disposed such that the low frequency resonating chamber 64 substantially encloses and surrounds the tuning aperture 38 stamp formed in the internal plate 12. The low frequency resonating chamber 64 is depicted as being of a generally trapezoidal configuration. Other configurations, of course, are possible, with the precise size and shape of the low frequency resonating chamber 64 being determined substantially by the acoustical characteristics of the system into which the muffler 10 is incorporated, and the size and shape of the space envelope for the muffler 10. It should also be noted that the external shell 16 is stamp formed to include an array of stiffening ribs 74 in the expansion chamber 62 and a similar array of stiffening ribs 76 in the low frequency resonating chamber 64. The stiffening ribs substantially prevent vibration and the noise associated therewith.

The external shell 18 is similar to the external shell 16, and includes a peripheral flange 80 which is dimensioned to be placed in register with the peripheral flange 60 of external shell 16. Furthermore, the peripheral flange 80 includes portions to closely engage peripheral locations 41 and 45 of the inlet channel 40 and the outlet channel 44 of the internal plate 14. The external shell 18 is further stamp formed to define an expansion chamber 82, a low frequency resonating chamber 84 and a crease 86 therebetween. The crease 86 is dimensioned to closely engage the internal plate 14, and therefore is stamp formed to include arcuate portions 88, 90 and 92 for engagement with the tuning channels 54 and 56 and the outlet channel 44 of the internal plate 14. It is not essential for the crease 86 to be in register with the crease 66 of external shell 16. However, the crease 86 must be disposed such that the arrays of perforations 46, 48 and 50 in the internal plate 14 lie within the expansion chamber 82. Furthermore, the crease 86 must be disposed such that the tuning aperture 58 stamp formed in the internal plate 14 is disposed within the low frequency resonating chamber 84. The specific volume and configuration of the low frequency resonating chamber 84 is dependent upon both the frequency of sounds to be attenuated and the available space. As noted above, the stiffening ribs 94 and 96 are stamp formed in the external shell 18 to minimize vibrations and associated noise.

Figure 2:
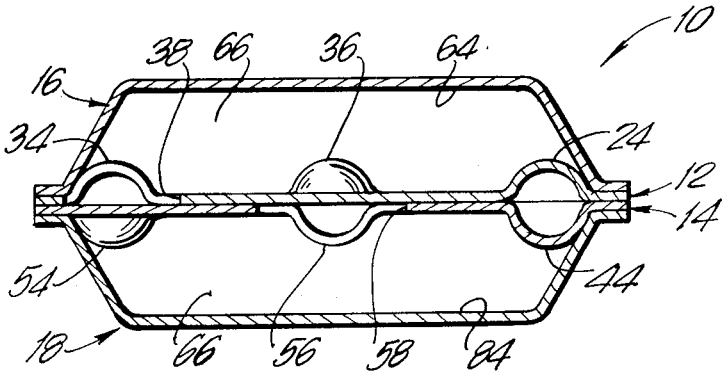
FIG. 2 is a cross-sectional view of the assembled muffler shown in FIG. 1.

The muffler 10 is assembled, as shown in FIG. 2, by merely securing the internal plates 12 and 14 to one another by welding, mechanical interconnection or the like. As a result, the inlet channel, return channel and outlet channel 20–24 of internal plate 12 will be in register with the corresponding channels 40–44 of internal plate 14 to define a continuous array of tubes for carrying exhaust gases. Additionally, the tuning channels 34 and 36 of the internal plate 12 will be in register with the tuning channels 54 and 56 of internal plate 14 to define two structurally and functional separate tuning tubes. However, the tuning tube defined by tuning channels 34 and 54 will terminate at the tuning aperture 38 in the internal plate 12, while the tuning tube defined by tuning channels 36 and 56 will terminate at the tuning aperture 58 in internal plate 14. Stated differently, the tuning tube defined by channels 34 and 54 will have an opening communicating from one side of the combined internal plates 12 and 14, while the tuning tube defined by channels 36 and 56 will have an opening extending from the other side of the combined internal plates 12 and 14.

The external shells 16 and 18 are then secured to the internal plates 12 and 14 and to one another around the respective peripheral flanges 60 and 80. As a result, the expansion chambers 62 and 82 will surround and substantially enclose the arrays of perforations 26–30 and 46–50. Additionally, the tuning tube defined by channels 34 and 54 will communicate with the low frequency resonating chamber 64 stamp formed in the external shell 16, while the tuning tube defined by channels 36 and 56 will communicate with the low frequency resonating chamber 84 stamp formed in the external shell 18. As noted previously, the cross-sectional dimensions of the two respective tuning tubes, the respective lengths of the tuning tubes and the respective volumes of the low frequency resonating chambers 64 and 84 are all determined independently depending upon the characteristics of the exhaust system.

Figure 3:
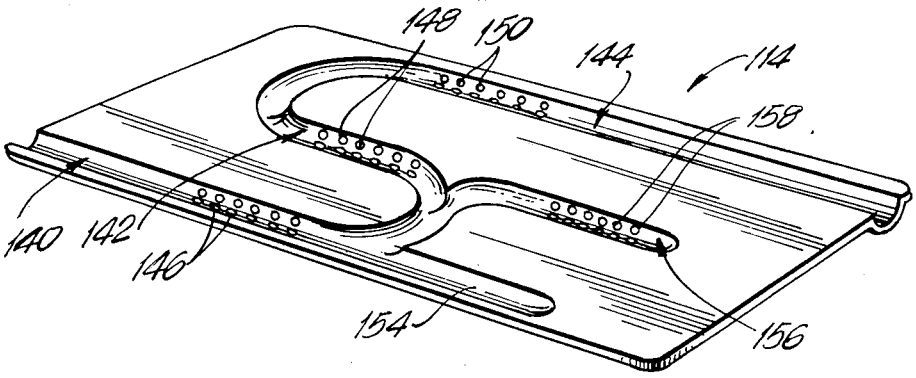
FIG. 3 is a perspective view of an alternate internal plate for use in the stamp formed muffler depicted in FIG. 1.

FIG. 3 shows an alternate internal plate 114 which could be substituted for the internal plate 14 on the muffler 10 illustrated in FIGS. 1 and 2. The internal plate 114 is similar to the internal plate 14 and includes an inlet channel 140, a return channel 142 and an outlet channel 144 which are disposed to be placed in register with the corresponding channels 20–24 of internal plate 12. The channels 140–144 of the internal plate 114 are further provided with arrays of perforations 146–150 which are disposed to lie within the expansion chamber 82 of external shell 18. The internal plate 114 is further provided with tuning channels 154 and 156 which are disposed to be in register with the tuning channels 34 and 36 of internal plate 12. However, unlike the internal plate 14, there is no large tuning aperture at the end of tuning channel 156. Rather, the tuning channel 156 is provided with a bleed pattern defined by an array of perforations 158 stamp formed entirely therethrough. More particularly, the perforations 158 are disposed to communicate with the low frequency resonating chamber 84 stamp formed in the external shell 18. Furthermore, the total area encompassed by the bleed pattern of perforations 158 is selected to achieve a desired noise attenuation function. Thus, on the muffler assembled with the internal plate 114, the tuning tube defined by the channels 34 and 154 will communicate with the low frequency resonating chamber 64 in the external shell 16. However, the tuning tube defined by the channels 36 and 156 will communicate with the low frequency resonating chamber 84 in external shell 18 through the bleed pattern of perforations 158. In view of this difference, the muffler formed with the internal plate 114 will exhibit noise attenuation characteristics distinct from the muffler 10 as illustrated in FIGS. 1 and 2.

Figure 4:
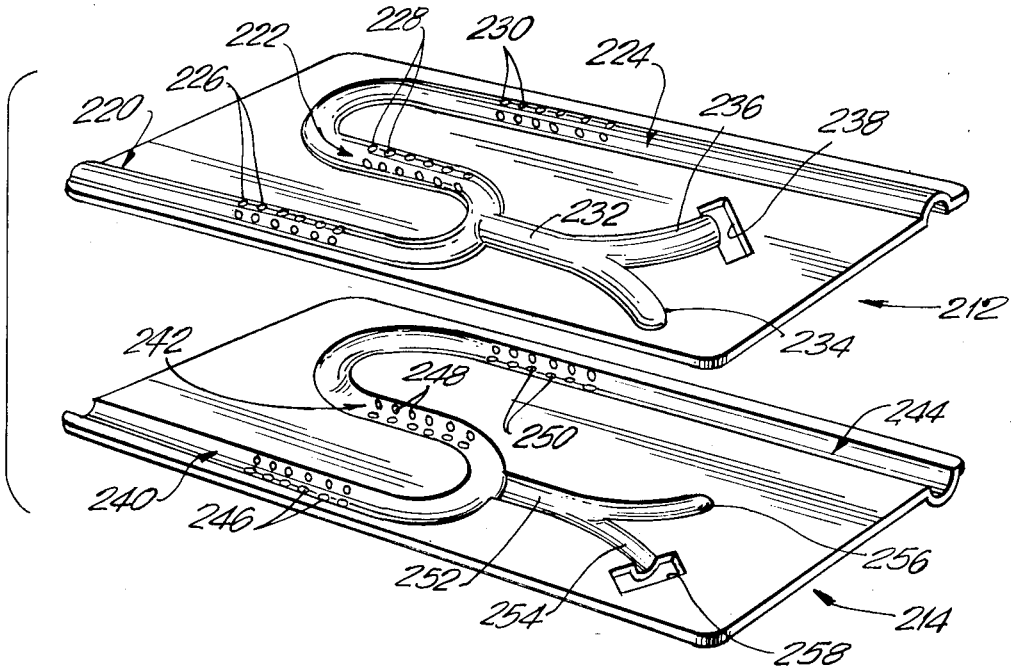
FIG. 4 is an exploded perspective view of an alternate pair of internal plates formed in accordance with the subject invention.

The dual tuning function can be achieved with arrangements of tuning tubes other than the two entirely separate tuning tubes shown in the muffler 10 of FIGS. 1–3. For example, with reference to FIG. 4, the internal plates 212 and 214 are structurally and functionally similar to the internal plates 12 and 14 depicted in FIG. 1. In particular, the internal plate 212 includes inlet channel 220, return channel 222 and outlet channel 224 which are provided respectively with arrays of perforations 226, 228 and 230. The perforation arrays 226–230 are disposed to lie within the expansion chamber 62. In contrast to the previously described internal plate 12, the internal plate 212 illustrated in FIG. 4 is provided with a single tuning channel 232 which communicates with the inlet channel 220 and the return channel 222 approximately at their juncture. The tuning channel 232 then branches into two separate tuning channels 234 and 236. The tuning channel 236 terminates at a tuning aperture 238.

The internal plate 214 of FIG. 4 is stamp formed to define an inlet channel 240, a return channel 242 and an outlet channel 244 which are provided respectively with arrays of perforations 246, 248 and 250. A single tuning tube 252 communicates with the inlet channel 240 and the return channel 242 at their juncture. The tuning tube 252 then divides into two separate tuning channels 254 and 256, with the tuning channel 254 terminating at a tuning aperture 258.

The channels stamp formed in the internal plate 212 are disposed to be in register with the channels stamp formed in the internal plate 214. As a result, a first tuning tube is defined by channels 232, 252, 236 and 256, and terminates at the tuning aperture 238 stamp formed in the internal plate 212. This tuning tube will communicate with the low frequency resonating chamber of the external shell secured to the internal plate 212. In a similar manner, a second tuning tube will be defined by channels 232, 252, 234 and 254, and will terminate at the tuning aperture 258. This tuning tube, on the other hand, will communicate with the low frequency resonating chamber stamp formed in the external shell secured to the internal plate 214. The noise attenuating characteristics of the resulting muffler will be determined by the respective volumes of the low frequency resonating chambers and by the dimensions of the respective tuning tubes.

Figure 5:
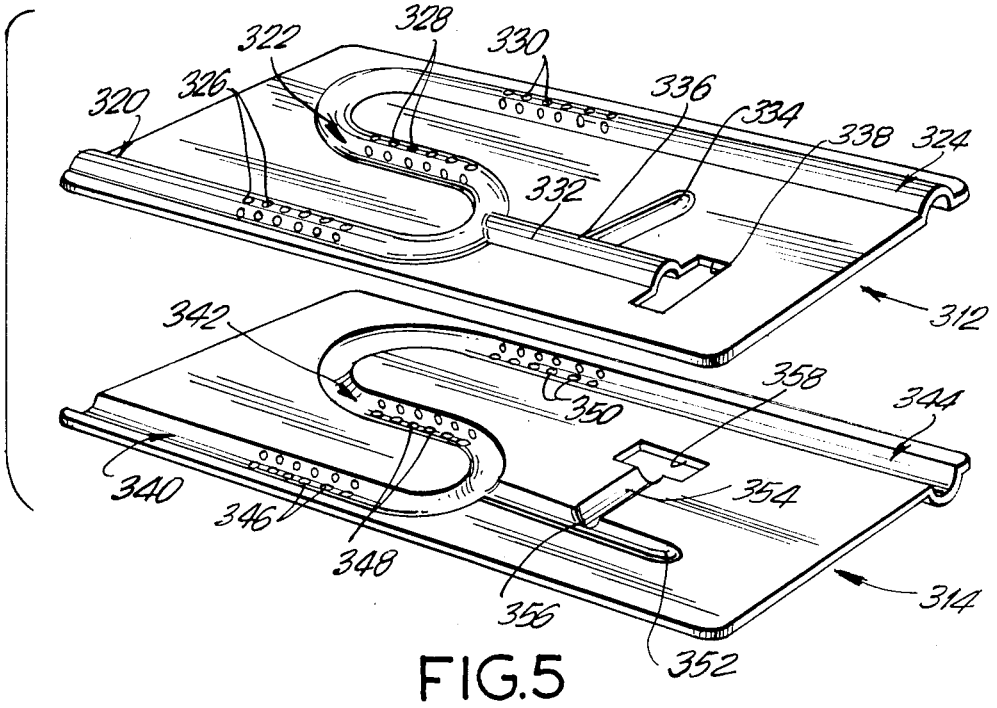
FIG. 5 is an exploded perspective view of a second alternate pair of internal plates formed in accordance with the subject invention.

Still another possible embodiment of the tuning tubes is illustrated in FIG. 5. In this embodiment, the internal plate 312 is stamp formed to include inlet channel 320, return channel 322 and outlet channel 324, with perforation arrays 326–330 formed therein. A first tuning channel 332 communicates with the inlet channel 320 and the return channel 322. A second tuning channel 334 intersects the first tuning channel at location 336. The first tuning channel 332 terminates at tuning aperture 338. In a similar manner, the internal plate 314 depicted in FIG. 5 includes inlet channel 340, return channel 342 and outlet channel 344 with arrays of perforations 346–350 stamp formed therein. The internal plate 314 includes a first tuning channel 352 which communicates with the inlet channel 340 and the return channel 342 approximately at their juncture. The tuning channel 352 does not terminate at an aperture. Rather, a second tuning channel 354 is stamp formed in internal plate 314 to intersect the first tuning channel 352 at location 356, and to extend to tuning aperture 358. As with the previously described embodiment, the tuning tube defined by tuning channels 332 and 352 will communicate with one low frequency resonating chamber, while the tuning tube defined by tuning channels 334 and 354 will communicate with another low frequency resonating chamber. These two tuning tubes and the corresponding low frequency resonating chambers will function independently in accordance with their respective dimensions.

The person skilled in this art will understand that the internal plates illustrated in FIGS. 4 and 5 can be incorporated into the stamp formed muffler 10 depicted in FIG. 1. It will further be understood that the respective pairs of internal plates depicted herein could be incorporated into a muffler having a wrapped outer shell and having appropriately formed baffles to divide the respective chambers from one another.

In summary, a muffler is provided with a pair of internal plates stamp formed to define an array of tubes therebetween. An external shell surrounds and encloses the internal plates. The external shell preferably is formed by a pair of shells, each of which is stamp formed to define a plurality of chambers. However, the external shell may be formed by sheet metal wrapped into a tubular configuration and used in conjunction with transversely extending baffles and muffler heads mechanically or otherwise connected thereto. The array of tubes stamp formed in the internal plates include at least two tuning tubes. One tuning tube terminates at a tuning aperture stamp formed in one of the two internal plates, while the other tuning tube terminates at a tuning aperture stamp formed in the other of the two internal plates. As a result, one tuning tube will communicate with a low frequency resonating chamber disposed adjacent one side of the joined internal plates, while the other tuning tube will communicate with a low frequency resonating chamber disposed adjacent the opposite side of the joined internal plates. The tuning tubes communicate with the array of tubes extending between the inlet and outlet of the muffler. The tuning tubes may be entirely separate from one another, or may intersect one another to include a common portion which communicates with the array of tubes extending between the inlet and outlet of the muffler.

While the invention has been described with respect to certain preferred embodiments, it is apparent that various changes can be made without departing from the scope of the invention as defined by the appended claims.

What is claimed is:

1. An exhaust muffler comprising an external shell and first and second internal plates, said first and second internal plates being disposed in face-to-face relationship with one another and disposed within and connected to said external shell, said internal plates being stamp formed to define a plurality of channels disposed to define an array of interconnected tubes between the internal plates, with each tube in the array being defined by opposed portions of the respective first and second internal plates, said array of tubes comprising an inlet tube to said muffler, an outlet tube from the muffler and first and second elongated tuning tubes, said first tuning tube comprising a tuning aperture stamp formed through the portion of said first internal plate defining said first tuning tube, and with the portion of said second internal plate defining the first tuning tube being substantially free of apertures, said second tuning tube comprising a tuning aperture stamp formed through the portion of the second internal plate defining said second tuning tube, and with the portion of said first internal plate defining said second tuning tube being substantially free of apertures, said external shell being formed to comprise a first low frequency resonating chamber surrounding the tuning aperture of the first tuning tube and to comprise a second low frequency resonating chamber surrounding the tuning aperture of said second tuning tube.

2. An exhaust muffler as in claim 1 wherein said tuning tubes communicate with the remaining tubes of said array of tubes at spaced apart locations.

3. An exhaust muffler as in claim 1 wherein said tuning tubes communicate with one another at a location spaced from the remaining tubes of said array of tubes.

4. An exhaust muffler as in claim 1 wherein said array of tubes comprises an inlet tube, a return tube extending from and in communication with said inlet tube and an outlet tube extending from and in communication with said return tube, selected portions of said inlet tube, said return tube and said outlet tube being stamp formed to include arrays of perforations therethrough, and wherein said muffler further comprises an expansion chamber surrounding said arrays of perforations and defined at least in part by said internal plates and said external shell.

5. An exhaust muffler as in claim 1 wherein said tuning tubes have different respective cross-sectional areas.

6. An exhaust muffler as in claim 1 wherein said tuning tubes have different respective lengths.

7. An exhaust muffler as in claim 1 wherein said first and second low frequency resonating chambers define different respective volumes.

8. An exhaust muffler as in claim 1 wherein the tuning aperture of said first tuning tube comprises a plurality of perforations extending through said first internal plate, said perforations defining a bleed pattern for providing communication between said first tuning tube and said first low frequency resonating chamber.

9. A stamp formed exhaust muffler comprising first and second stamp formed internal plates secured in face-to-face relationship, said internal plates being stamp formed to define an array of channels disposed such that the channels of one said internal plate and the opposed channels of the other internal plate define an inlet tube to said muffler, a return tube in communication with said inlet tube, an outlet tube from said muffler in communication with said return tube and first and second tuning tubes in communication with at least one of said inlet tube, said return tube and said outlet tube, selected ones of said inlet, outlet and return tubes being provided with arrays of perforations therethrough, a channel of said first tuning tube defined by said second internal plate being substantially continuous, but with a channel of said first tuning tube defined by said first internal plate comprising a tuning aperture in said first internal plate, a channel of said second tuning tube defined by said first internal plate; being substantially continuous, but with a channel of said second tuning tube defined by said second internal plate comprising a tuning aperture in said second internal plate; and first and second stamp formed external shells connected to said first and second internal plates respectively, said first external shell being stamp formed to define a low frequency resonating chamber surrounding said tuning aperture in said first internal plate and said second external shell being stamp formed to define a second low frequency resonating chamber surrounding said tuning aperture in said second internal plate, said external shells further being stamp formed to define an expansion chamber surrounding the perforations in the selected ones of said inlet tube, said return tube and said outlet tube whereby the low frequency resonating chambers are separated from one another by said internal plates.

10. A stamp formed muffler as in claim 9 wherein said first and second tuning tubes communicate with other tubes in said array of tubes at spaced apart locations.

11. A stamp formed muffler as in claim 9 wherein said first and second tuning tubes communicate with one another at a location spaced from the other tubes of said array of tubes.

12. A stamp formed muffler as in claim 9 wherein said first and second tuning tubes are of different lengths.

13. A stamp formed muffler as in claim 9 wherein said first and second tuning tubes are of different cross-sectional dimensions.

14. A stamp formed muffler as in claim 9 wherein said first and second low frequency resonating chambers are of different volumes.

15. A stamp formed muffler as in claim 9 wherein the tuning aperture extending through said first internal plate is defined by an array of perforations defining a bleed pattern providing communication between said first tuning tube and said first low frequency resonating chamber.

16. A stamp formed exhaust muffler for attenuating the noise of exhaust gas flowing therethrough, comprising first and second internal plates secured in face-to-face relationship, said internal plates being stamp formed to define a plurality of oppositely directed interconnected channels therein such that the channels of said first internal plate are substantially in register with the channels of the second internal plate, each said internal plate comprising an inlet channel, a return channel in communication with said inlet channel, an outlet channel in communication with said return channel and first and second tuning channels in communication with at least one of said inlet, return and outlet channels, such that the opposed channels define an inlet tube to the muffler, a return tube in communication with said inlet tube, an outlet tube in communication with said return tube and first and second tuning tubes in communication with at least one of said inlet, return and outlet tubes, said first tuning channel of said first internal plate comprising a tuning aperture extending therethrough, but the second turning channel of said first internal plate being substantially free of apertures, said second turning channel of said second internal plate comprising a tuning aperture extending therethrough, but with the first turning channel of said second internal plate being substantially free of apertures, such that the first tuning tube communicates through the tuning aperture in said first internal plate and such that the second tuning tube communicates through the tuning aperture in said second internal plate; said muffler further comprising first and second stamp formed external shells connected to said first and second internal plates, said first external shell being stamp formed to define a first low frequency resonating chamber surrounding the tuning aperture in the first tuning channel of said first internal plate, said second external shell being stamp formed to define a second low frequency resonating chamber surrounding the tuning aperture in the second tuning channel of said second internal plate, whereby the first and second low frequency resonating chambers are separated from one another by said internal plates, and whereby dimensions of the first and second tuning channels and the volumes of the first and second low frequency resonating chambers are selected in accordance with acoustical characteristics of the noise to be attenuated by the muffler.

17. A muffler as in claim 16 wherein selected portions of said inlet tube, said return tube and said outlet tube are provided with perforations extending therethrough, and wherein said first and second external shells are stamp formed to define expansion chambers surrounding the perforations and substantially separated from the first and second low frequency resonating chambers.

18. A muffler as in claim 17 wherein said channels are stamp formed to define reversing tubular portions intermediate said inlet tube and said return tube and intermediate said return tube and said outlet tube for reversing the flow of the exhaust gas, at least one of said tuning tubes being in communication with one of the inlet, return and outlet tubes at one said reversing tubular portion.

19. A muffler as in claim 9 wherein one of said tuning tubes is generally axially aligned with said inlet tube.

* * * * *